US009593862B2

(12) United States Patent
Scipio et al.

(10) Patent No.: US 9,593,862 B2
(45) Date of Patent: Mar. 14, 2017

(54) AIR DISRUPTION SYSTEM FOR AN ENCLOSURE

(71) Applicant: General Electric Company, Schenectady, NY (US)

(72) Inventors: Alston Ilford Scipio, Mableton, GA (US); Dale Joel Davis, Greenville, SC (US); Sanji Ekanayake, Mableton, GA (US); Massoud Parisay, Atlanta, GA (US)

(73) Assignee: General Electric Company, Schenectady, NY (US)

( * ) Notice: Subject to any disclaimer, the term of this patent is extended or adjusted under 35 U.S.C. 154(b) by 569 days.

(21) Appl. No.: 13/960,321

(22) Filed: Aug. 6, 2013

(65) Prior Publication Data

US 2015/0044031 A1 Feb. 12, 2015

(51) Int. Cl.

| | |
|---|---|
| ***F24F 13/08*** | (2006.01) |
| ***F01D 21/14*** | (2006.01) |
| ***F01D 25/12*** | (2006.01) |

(52) U.S. Cl.

CPC ..... *F24F 13/08* (2013.01); *F01D 21/14* (2013.01); *F01D 25/12* (2013.01)

(58) Field of Classification Search

CPC ..... F05D 2260/608; F05D 2260/605; F01D 25/08; F01D 25/10; F01D 25/12

USPC ..... 415/116, 117, 175, 178, 108

See application file for complete search history.

(56) References Cited

U.S. PATENT DOCUMENTS

| | | | | |
|---|---|---|---|---|
| 3,654,768 | A * | 4/1972 | Inglis | F25B 9/04 62/5 |
| 3,759,449 | A * | 9/1973 | Ruthman | B23Q 11/1084 239/413 |
| 5,155,358 | A * | 10/1992 | Larson | F27D 21/02 250/238 |
| 6,428,410 | B1 * | 8/2002 | Campbell | F24F 7/06 137/565.22 |
| 6,983,607 | B2 | 1/2006 | Grove et al. | |
| 8,006,476 | B2 * | 8/2011 | Hosel | D01G 15/00 57/308 |
| 2005/0086943 | A1 * | 4/2005 | Grove | F01D 25/14 60/772 |
| 2007/0209370 | A1 * | 9/2007 | Broerman | F25B 9/04 62/5 |
| 2007/0246008 | A1 * | 10/2007 | Gerum | B60T 17/02 123/316 |
| 2009/0235672 | A1 * | 9/2009 | Broerman | F25B 9/04 62/5 |
| 2013/0005237 | A1 * | 1/2013 | Baten | F02C 3/32 454/252 |

(Continued)

FOREIGN PATENT DOCUMENTS

GB 1445221 A * 8/1976 ..... F04F 5/16

*Primary Examiner* — Patrick Maines

(74) *Attorney, Agent, or Firm* — Ernest G. Cusick; Frank A. Landgraff

(57) ABSTRACT

An air disruption system for an enclosure includes an air delivery system, at least one plenum including an inlet fluidically connected to the air delivery system and at least one outlet, and a controller operatively connected to the air delivery system. The controller is configured and disposed to selectively cause one or more discrete amounts of air to pass into the at least one plenum and flow through the outlet creating a localized air disruption.

13 Claims, 2 Drawing Sheets

(56) References Cited

U.S. PATENT DOCUMENTS

2015/0056912 A1* 2/2015 Scipio ..... F24F 11/053
454/258

* cited by examiner

AIR DISRUPTION SYSTEM FOR AN ENCLOSURE

BACKGROUND OF THE INVENTION

The subject matter disclosed herein relates to the art of enclosures and, more particularly, to an air disruption system for an enclosure that may experience a build-up of undesirable gases.

Many times enclosures are used to house machinery that operate on fuel and produce exhaust gases. For example, a turbomachine may include a compressor portion linked to a turbine portion through a common compressor/turbine shaft and a combustor assembly. An inlet airflow is passed through an air intake toward the compressor portion. In the compressor portion, the inlet airflow is compressed through a number of sequential stages toward the combustor assembly. In the combustor assembly, the compressed airflow mixes with a fuel to form a combustible mixture. The combustible mixture is combusted in the combustor assembly to form hot gases. The hot gases are guided along a hot gas path of the turbine portion through a transition piece. The hot gases expand through a number of turbine stages acting upon turbine buckets mounted on wheels to create work that is output, for example, to power a generator, a pump, or to provide power to a vehicle.

During operation, the turbomachine produces heat which may raise internal temperatures of the enclosure. Raising the internal temperature of the enclosure may have a negative impact on turbomachine efficiency. Many turbomachine enclosures include ventilation systems that draw air from the enclosure. Conventional ventilation systems include fans, that when operated, create an airflow that opens louvers exposing internal spaces of the enclosure to ambient. Current ventilation systems rely on an operator to start and stop operation or on parameters such as turbomachine temperature enclosure and exhaust air temperature. In addition to heat build-up, unwanted gases may accumulate in portions of the enclosure that do not experience airflow currents generated by the ventilation system.

BRIEF DESCRIPTION OF THE INVENTION

According to one aspect of an exemplary embodiment, an air disruption system for an enclosure includes an air delivery system, at least one plenum including an inlet fluidically connected to the air delivery system and at least one outlet, and a controller operatively connected to the air delivery system. The controller is configured and disposed to selectively cause one or more discrete amounts of air to pass into the at least one plenum and flow through the at least one outlet.

According to another aspect of an exemplary embodiment, a turbomachine enclosure includes a plurality of walls that define an interior portion having at least one air disruption zone, a turbomachine system arranged within the interior portion, and an air disruption system including an air delivery system, and at least one plenum extending through the at least one air disruption zone. The at least one plenum includes an inlet fluidically connected to the air delivery system and at least one outlet fluidically exposed to a portion of the at least one air disruption zone. A controller is operatively connected to the air delivery system. The controller is configured and disposed to selectively cause one or more discrete amounts of air to pass into the at least one plenum and flow through the at least one outlet to create a localized disturbance of air in the portion of the at least one air disruption zone.

According to yet another aspect of an exemplary embodiment, a method of disrupting air in a turbomachine enclosure includes selectively delivering a discrete amount of air from an air delivery system to at least one air plenum, passing the discrete amount of air into the at least one plenum, and discharging the discrete amount of air through at least one outlet of the at least one plenum creating a localized air disruption in the turbomachine enclosure.

These and other advantages and features will become more apparent from the following description taken in conjunction with the drawings.

BRIEF DESCRIPTION OF DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
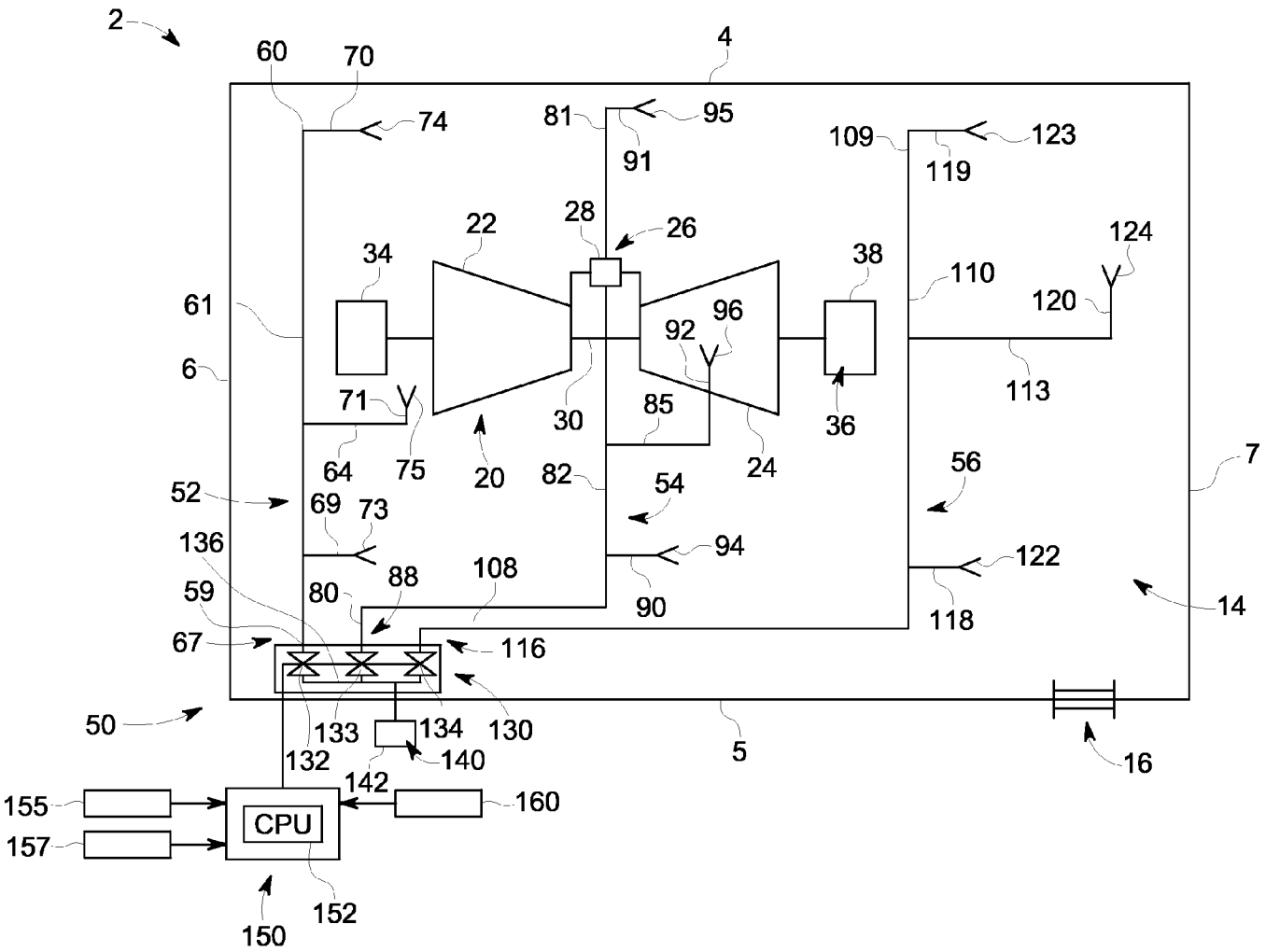
FIG. 1 is a schematic view of a turbomachine enclosure including an air disruption system, in accordance with an exemplary embodiment.

A turbomachine enclosure, in accordance with an exemplary embodiment, is indicated generally at 2, in FIG. 1. Turbomachine enclosure 2 includes a first wall 4 and an opposing, second wall 5 that are joined by a third wall 6, and an opposing, fourth wall 7. A fifth wall or roof (not shown) joins first, second, third, and fourth walls 4-7 to define an interior portion 14. A door 16 is provided in second wall 5 to provide access to interior portion 14. Turbomachine enclosure 2 houses a turbomachine system 20 including a compressor portion 22 coupled to a turbine portion 24 through a combustor assembly 26. Combustor assembly 26 includes one or more combustors, one of which is indicated at 28. Compressor portion 22 is mechanically linked to turbine portion 24 through a common compressor/turbine shaft 30. Compressor portion 22 includes an intake 34 and turbine portion 24 is mechanically linked to a load 36 that may take the form of a generator 38. Of course it should be understood that load 36 may also be joined to compressor portion 22.

In accordance with an exemplary embodiment, turbomachine enclosure 2 includes an air disruption system 50. As will be detailed more fully below, air disruption system 50 selectively delivers discrete amounts, or "puffs", of air to various locations within interior portion 14. The puffs of air create localized disturbances that may cause any build-up of undesirable gases to be disrupted and caused to circulate within interior portion 14 and ultimately passed through an exhaust system (not shown) as a result of air currents created by a ventilation system (also not shown).

Air disruption system 50 includes a first air plenum 52 that extends through and defines a first air disruption zone (not separately labeled), a second air plenum 54 that extends through and defines a second air disruption zone (also not separately labeled), and a third air plenum 56 that extends through and defines a third air disruption zone (not separately labeled). At this point it should be understood that the number of air disruption zones may vary depending upon internal characteristics of turbomachine enclosure 2. Internal characteristics may include air flow patterns, CFD analysis of stagnant air space, known dead air pocket locations, and the like. First air plenum 52 extends from a first end 59 to a second end 60 through an intermediate portion 61. A first branch plenum 64 extends from, and is fluidically connected with, intermediate portion 61. First air plenum 52 includes an inlet 67 at first end 59, a first outlet 69 downstream of inlet 67, a second outlet 70 proximate to second end 60 and a third outlet 71 provided in first branch plenum 64. First outlet 69 includes a first air discharge nozzle 73, second outlet 70 includes a second air discharge nozzle 74, and third outlet 71 includes a third air discharge nozzle 75. First, second, and third air discharge nozzles 73-75 create a desired discharge characteristic, e.g., shape, velocity and/or direction, of the puff of air passing from respective ones of first, second, and third outlets 69-71.

In a manner similar to that described above, second air plenum 54 extends from a first end 80 to a second end 81 through an intermediate portion 82. A second branch plenum 85 extends from, and is fluidically connected with, intermediate portion 82. Second air plenum 54 includes an inlet 88 at first end 80, a first outlet 90 downstream of inlet 88, a second outlet 91 proximate to second end 81 and a third outlet 92 provided in second branch plenum 85. First outlet 90 includes a first air discharge nozzle 94, second outlet 91 includes a second air discharge nozzle 95, and third outlet 92 includes a third air discharge nozzle 96. First, second, and third air discharge nozzles 94-96 create a desired discharge characteristic, e.g., shape, velocity and/or direction, of the puff of air passing from respective ones of first, second, and third outlets 90-92.

In a manner also similar to that described above, third air plenum 56 extends from a first end 108 to a second end 109 through an intermediate portion 110. A third branch plenum 113 extends from, and is fluidically connected with, intermediate portion 110. Third air plenum 56 includes an inlet 116 at first end 108, a first outlet 118 downstream of inlet 116, a second outlet 119 proximate to second end 109, and a third outlet 120 provided in third branch plenum 113. First outlet 118 includes a first air discharge nozzle 122, second outlet 119 includes a second air discharge nozzle 123, and third outlet 120 includes a third air discharge nozzle 124. First, second, and third air discharge nozzles 122-124 create a desired discharge characteristic, e.g., shape, velocity and/or direction, of the puff of air passing from respective ones of first, second, and third outlets 118-120.

In further accordance with an exemplary embodiment, air disruption system 50 includes a manifold 130 that includes a first valve 132, a second valve 133, and a third valve 134. Each of first, second, and third valves 132-134 includes an outlet (not separately labeled) that fluidically connects with respective ones of inlets 67, 88 and 116. Each of first, second, and third valves 132-134 also includes an inlet (also not separately labeled) fluidically connected to a common air inlet conduit 136. Common air inlet conduit 136 is fluidically connected to an air delivery system 140 which, in accordance with an aspect of the exemplary embodiment, takes the form of a compressed air delivery system 142. Compressed air delivery system 142 may constitute a stand-alone supply of compressed air, such as a dedicated air compressor, or a source of compressed air, such as a connection to compressor portion 22 or other compressed air supply source.

In still further accordance with the exemplary embodiment, air disruption system 50 includes a microprocessor based controller 150 having predetermined logic that sets forth an operating sequence and protocol operatively connected to each of the first, second and third valves 132-134. Controller 150 includes a central processor unit (CPU) 152 that receives and executes instructions received through an automatic control input 155, a manual control input 157, and a hazardous gas detected input 160. As will be detailed more fully below, controller 150 may open one or more of valves 132-134 to deliver compressed air to a corresponding one of air discharge nozzles 122-124. Controller 150 may open one or more of valves 132-134 for a time period that may be selectively adjustable by an operator or a predetermined time period. For example, controller 150 may open one or more of valves 132-134 for a short period to deliver a desired amount of air, such as a "puff", or short burst of air, or may open one or more of valves 132-134, to deliver a constant stream of compressed air. Also, controller 150 may stagger opening valves 132-134, such as first opening first valve 132, then opening second valve 133 followed by opening third valve 134. Further, controller 150 may vary air delivery to first, second and third air plenums 52, 54 and 56. Subsequent valve openings may occur while the previously opened valve is still open, or after the previously opened valve is closed.

Figure 2:
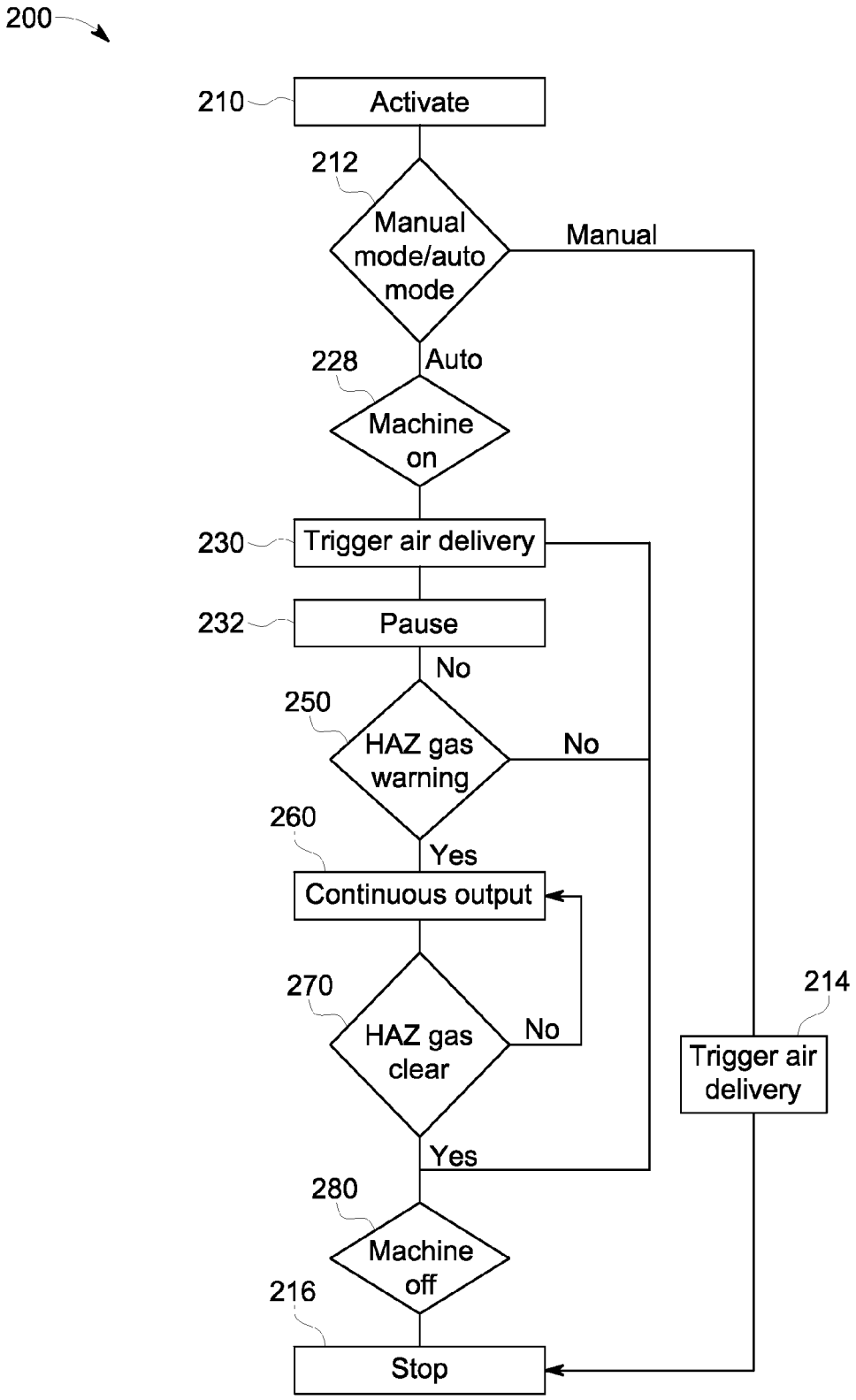
FIG. 2 is a dataflow diagram illustrating a method of selectively disrupting air in the turbomachine enclosure of FIG. 1.

Reference will now follow to FIG. 2 in describing a method 200 of selectively disrupting air in turbomachine enclosure 2. Controller 150 is activated in block 210. A determination is made, in block 212, whether controller 150 was activated through manual control input 157 or through automatic control input 155. If controller 150 was activated through manual control input 157, one or more of valves 132-134 are opened to deliver a desired amount of air into a respective one of first, second and third air plenums 52, 54 and/or 56, in block 214. The desired amount of air is passed through respective ones of air discharge nozzles 73-75, 94-96 and/or 122-124 to create localized air disturbances causing stagnant air to be caught up in airstreams created by the ventilation system. After delivering the desired amount of air, controller 150 closes the one or more of valves 132-134 and awaits additional input, in block 216.

If controller 150 is activated through automatic control input 155, a determination is made in block 228 whether turbomachine system 20 is in operation. Once operation of turbomachine system 20 is sensed, one or more of valves 132-134 are opened to deliver a desired amount of air into a respective one of first, second, and third air plenums 52, 54 and/or 56, in block 230. In a manner similar to that discussed above, the desired amount of air is passed through respective ones of air discharge nozzles 73-75, 94-96 and/or 122-124 to create localized air disturbances causing stagnant air to be caught up in airstreams created by the ventilation system. After delivering the desired amount of air, controller 150 pauses for a predetermined time period, in block 232.

Controller 150 also determines whether a signal was received through hazardous gas detected input 160, in block 250. If no hazardous gas was detected, controller 150 returns to block 230 and opens one or more of valves 132-134 to deliver another puff or puffs of compressed air. The cycle of delivering desired amount of air continues. If hazardous gas was detected, in block 250, all valves 132-134 are opened, in block 260, to deliver a continuous stream of compressed air into first, second, and third air plenums 52, 54 and 56 or help dilute or remove any detected hazardous gases. The valves remain open until manually stopped or an all clear signal is received, in block 270. Once an all clear signal is received, controller 150 returns to delivering the desired amount of air into first, second, and third plenums 52, 54 and 56 until turbomachine system 20 ceases operation, as indicated in block 280.

At this point it should be understood that the air disruption system, in accordance with exemplary embodiments, delivers desired amounts of air into selected areas of a turbomachine enclosure. The desired amounts of air create localized disturbances that cause stagnant pockets, or dead air spaces, to mix with air currents provided by a ventilation system. In this manner, any build-up of unwanted gases in the turbomachine enclosure can be reduced. The air disruption system may work in cooperation with a hazardous gas detection system, as described above, or may be operated without a hazardous gas input depending upon local requirements. Further it should be understood that the number and location of air discharge nozzles may vary. Also, while described as being employed in a turbomachine enclosure, it should be understood that the exemplary embodiments may be incorporated into any enclosures in which hazardous gas build up mitigation is desirable.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. An air disruption system for an enclosure comprising:
an air delivery system;
at least one plenum including an inlet fluidically connected to the air delivery system and at least one outlet; and
a controller operatively connected to the air delivery system, the controller being configured and disposed to selectively cause one or more discrete amounts of air to pass into the at least one plenum and flow through the at least one outlet creating a localized air disruption, wherein the at least one plenum extends from a first end to a second end through an intermediate portion, the inlet being arranged at the first end and the at least one outlet being arranged at one of the second end and the intermediate portion and wherein the at least one outlet includes a plurality of outlets, at least one of the plurality of outlets being arranged at the second end and another at least one of the plurality of outlets being arranged along the intermediate portion; and the air disruption system further comprising: a branch plenum extending from the intermediate portion of the at least one plenum, one of the plurality of outlets being arranged in the branch plenum.

2. The air disruption system according to claim 1, further comprising: a valve fluidically connected at the inlet of the at least one plenum, the controller being configured and disposed to open the valve to selectively cause the one or more discrete amounts of air to pass into the at least one plenum and flow through the at least one outlet.

3. The air disruption system according to claim 1, wherein the air delivery system includes a compressed air delivery system.

4. The air disruption system according to claim 1, wherein the at least one outlet comprises an air discharge nozzle.

5. A turbomachine enclosure comprising:
a plurality of walls that define an interior portion having at least one air disruption zone;
a turbomachine system arranged within the interior portion; and
an air disruption system comprising:
an air delivery system;
at least one plenum extending through the at least one air disruption zone, the at least one plenum including an inlet fluidically connected to the air delivery system and at least one outlet fluidically exposed to a portion of the at least one air disruption zone; and
a controller operatively connected to the air delivery system, the controller being configured and disposed to selectively cause one or more discrete amounts of air to pass into the at least one plenum and flow through the at least one outlet to create a localized air disruption in the portion of the at least one air disruption zone, wherein the at least one plenum extends from a first end to a second end through an intermediate portion, the inlet being arranged at the first end and the at least one outlet being arranged at one of the second end and the intermediate portion, wherein the at least one outlet includes a plurality of outlets, at least one of the plurality of outlets being arranged at the second end and another at least one of the plurality of outlets being arranged along the intermediate portion and
the turbomachine enclosure further comprising: a branch plenum extending from the intermediate portion of the at least one plenum, one of the plurality of outlets being arranged in the branch plenum.

6. The turbomachine enclosure according to claim 5, further comprising: a valve fluidically connected at the inlet of the at least one plenum, the controller being configured and disposed to open the valve to selectively cause the one or more discrete amounts of air to pass into the at least one plenum and flow through the at least one outlet.

7. The turbomachine enclosure according to claim 5, wherein the air delivery system includes a compressed air delivery system.

8. The turbomachine enclosure according to claim 5, wherein the at least one outlet comprises an air discharge nozzle.

9. A method of disrupting air in a turbomachine enclosure, the turbomachine enclosure comprises at least one plenum extending from a first end to a second end through an intermediate portion, the least one plenum including an inlet fluidically connected to the air delivery system and at least one outlet, the inlet being arranged at the first end and the at least one outlet being arranged at one of the second end and the intermediate portion, wherein the at least one outlet includes a plurality of outlets, at least one of the plurality of outlets being arranged at the second end and another at least one of the plurality of outlets being arranged along the intermediate portion and a branch plenum extending from the intermediate portion of the at least one plenum, one of the plurality of outlets being arranged in the branch plenum selectively delivering a discrete amount of air from an air delivery system to at least one air plenum; the method comprising:

disrupting air in a turbomachine enclosure comprises passing the discrete amount of air into the at least one air plenum; and discharging the discrete amount of air through at least one outlet of the at least one air plenum creating a localized air disruption in the turbomachine enclosure.

10. The method of claim 9, wherein selectively delivering the discrete amount of air into at least one air plenum includes passing an amount of compressed air into the at least one air plenum.

11. The method of claim 9, wherein discharging the discrete amount of air through the at least one outlet includes passing a puff of air through the at least one outlet.

12. The method of claim 9, wherein discharging the discrete amount of air through the at least one outlet includes passing the discrete amount of air through at least one discharge nozzle for a selectively adjustable time period.

13. The method of claim 9, wherein discharging the discrete amount of air through the at least one outlet includes passing the discrete amount of air through at least one discharge nozzle for a predetermined time period.

* * * * *